US005116231A

United States Patent [19]

Oki et al.

[11] Patent Number: 5,116,231

[45] Date of Patent: May 26, 1992

[54] INTAKE SYSTEM FOR AUTOMOBILE ENGINE

[75] Inventors: Nariyasu Oki; Tsunetoshi Yokokura; Koji Mizuno, all of Hiroshima; Katsutoshi Shimada, Iwakuni; Kazuyuki Yamamoto, Hiroshima, Japan

[73] Assignee: Mazda Motor Corporation, Hiroshima, Japan

[21] Appl. No.: 721,350

[22] Filed: Jun. 28, 1991

[30] Foreign Application Priority Data

Jun. 29, 1990 [JP] Japan ..... 2-69924
Sep. 28, 1990 [JP] Japan ..... 2-259209

[51] Int. Cl.[5] ..... F02M 35/10
[52] U.S. Cl. ..... 123/52 MB
[58] Field of Search ..... 123/52 M, 52 MV, 52 MC, 123/52 MB, 52 MF, 52 ML

[56] References Cited

U.S. PATENT DOCUMENTS 4,679,531 7/1987 Hitomi et al. ..... 123/52 MB

FOREIGN PATENT DOCUMENTS 0376299 7/1990 European Pat. Off. ..... 123/52 M
2823393 12/1978 Fed. Rep. of Germany ... 123/52 M
3424639 1/1985 Fed. Rep. of Germany ... 123/52 M
0219866 9/1988 Japan ..... 123/52 M
0285258 11/1988 Japan ..... 123/52 M

*Primary Examiner*—David A. Okonsky
*Attorney, Agent, or Firm*—Fleit, Jacobson, Cohn, Price, Holman & Stern

[57] ABSTRACT

An intake system includes an air inlet passage for introducing air into an air cleaner. The air inlet passage is formed by an outside passage, formed with an inlet opening at an upper portion thereof and extending downward from the inlet opening, an inside passage, extending upward to the air cleaner, and a generally U-shaped intermediate passage, extending between the outside and inside passages so as to form a space therebetween. A liquid container is formed integrally with a stationary resonator disposed close to the space. The resonator is connected, by a connecting passage, with the air inlet passage at the generally U-shaped intermediate passage.

15 Claims, 8 Drawing Sheets

INTAKE SYSTEM FOR AUTOMOBILE ENGINE

The present invention relates to an intake system for an automobile engine, and more particularly, to an engine intake system equipped with an air cleaner, air suction means for introducing air into the air cleaner, and a silencing means.

BACKGROUND OF THE INVENTION

1. Field of the Invention

Typically, an intake system provided on an automobile engine is equipped with silencing means in an intake air passage so as to decrease suction noises caused due to pulsations of intake air introduced in the intake air passage. When a suction means is provided in the intake passage, the suction means is provided with a certain length and volume, forming a structure with closed ends which is connected to the air intake passage. The intake system with such a volume forming structure is installed in an engine room of a vehicle together with the engine. To install the engine, together with the intake system and its associated elements, in the small space of the engine room, the intake system, with a silencing means, must be compact in structure and small in size.

2. Description of Related Art

In order for the intake system to be made small in size, the intake system may include a particular type of air cleaner provided with a space which functions to lower the level of intake suction noises. Such an air cleaner may be referred to as a "built-in silencer" type. The built-in silencer type of air cleaner helps make the intake system small in overall size. Such an intake system is known from, for instance, Japanese Unexamined Utility Model Publication No. 60-102,456.

Noises caused in an intake passage include noises produced by pulsations of air in the intake passage, mechanical noises caused by vibrations of mechanical members, such as a pipe forming the intake passage or an air cleaner case, and noises due to an air flow and the air cleaner case. Some noises, such as the noises due to the mechanical vibrations of the air cleaner case and the intake passage pipe, can be silenced effectively by silencing means specifically disposed at a proper location outside the air cleaner; for instance, such silencing means may be disposed at an air inlet of the intake passage through which air into the air cleaner is introduced. For this reason, it is preferable for the intake system to include the silencing means in a portion in which the air inlet of the intake passage is formed. However, since the engine room generally has no room left available around the air inlet, it is difficult to install the silencing means, which must be in communication with the air inlet of the intake passage, without enlarging the engine room and/or rearranging various elements associated with and surrounding the air inlet.

If the engine room is enlarged so as to accommodate the silencing means, which must be in communication with the air inlet of the intake passage, the part formed by the air inlet becomes low in mechanical strength or rigidity.

SUMMARY OF THE INVENTION

It is a primary object of the present invention to provide an intake system in which silencing means, connected to an air inlet passage, can be effectively arranged in an engine room without occupying a large amount of room and without requiring rearrangement of associated elements.

It is another object of the present invention to provide an intake system in which an air inlet passage portion can be properly mechanically supported.

According to a preferred embodiment of the present invention, the intake system comprises an air cleaner connected to one end of a main intake passage remote from an internal combustion engine and an air inlet passage connected to the air cleaner for introducing air into the air cleaner. The intake air inlet passage includes an outside passage portion, which is formed with an inlet opening at an upper portion thereof and extends downward from said inlet opening. An inside passage portion extends upward to the air cleaner, and a generally U-shaped intermediate passage portion extends between the outside and inside portions so as to form a space between the outside and inside portions. A liquid container, such as a reservoir tank or washer liquid tank, which is formed with silencing means having an interior space therein for decreasing noises caused by intake air introduced into the intake system, is stationary and disposed close to or in the space formed between the outside and inside passage portions. The intake system further comprises a connecting passage for connecting and communicating the interior space with the intake air inlet passage at the generally U-shaped intermediate portion.

BRIEF DESCRIPTION OF THE DRAWINGS

The above and other objects and features of the present invention will be apparent from the following description of preferred embodiments thereof when considered in conjunction with the accompanying drawings, in which similar reference numerals have been used to designate the same or similar elements throughout the drawings, and in which.

DETAILED DESCRIPTION OF THE PREFERRED EMBODIMENTS

Figure 1:
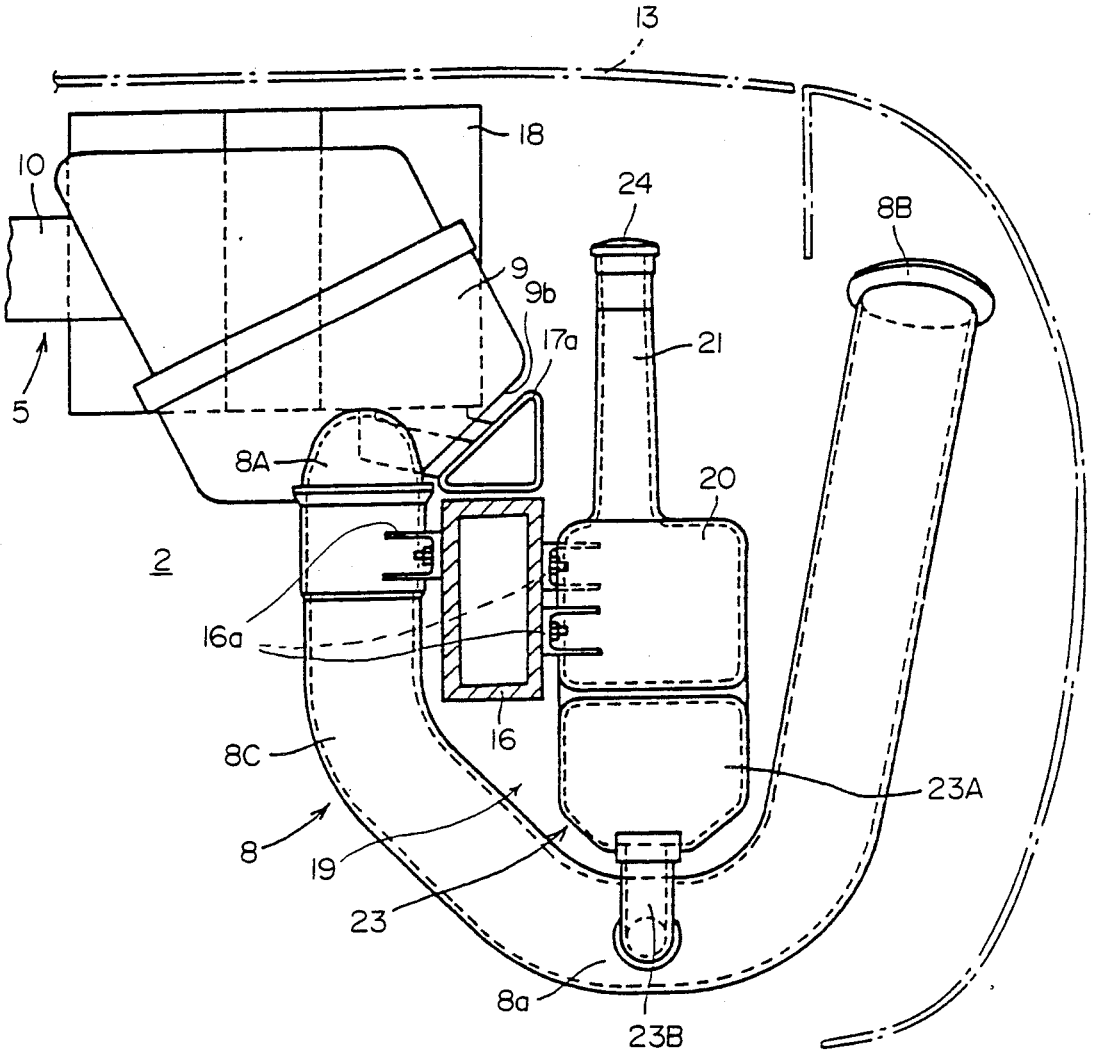
FIG. 1 is a front view of an intake system in accordance with a preferred embodiment of the present invention.
Figure 3:
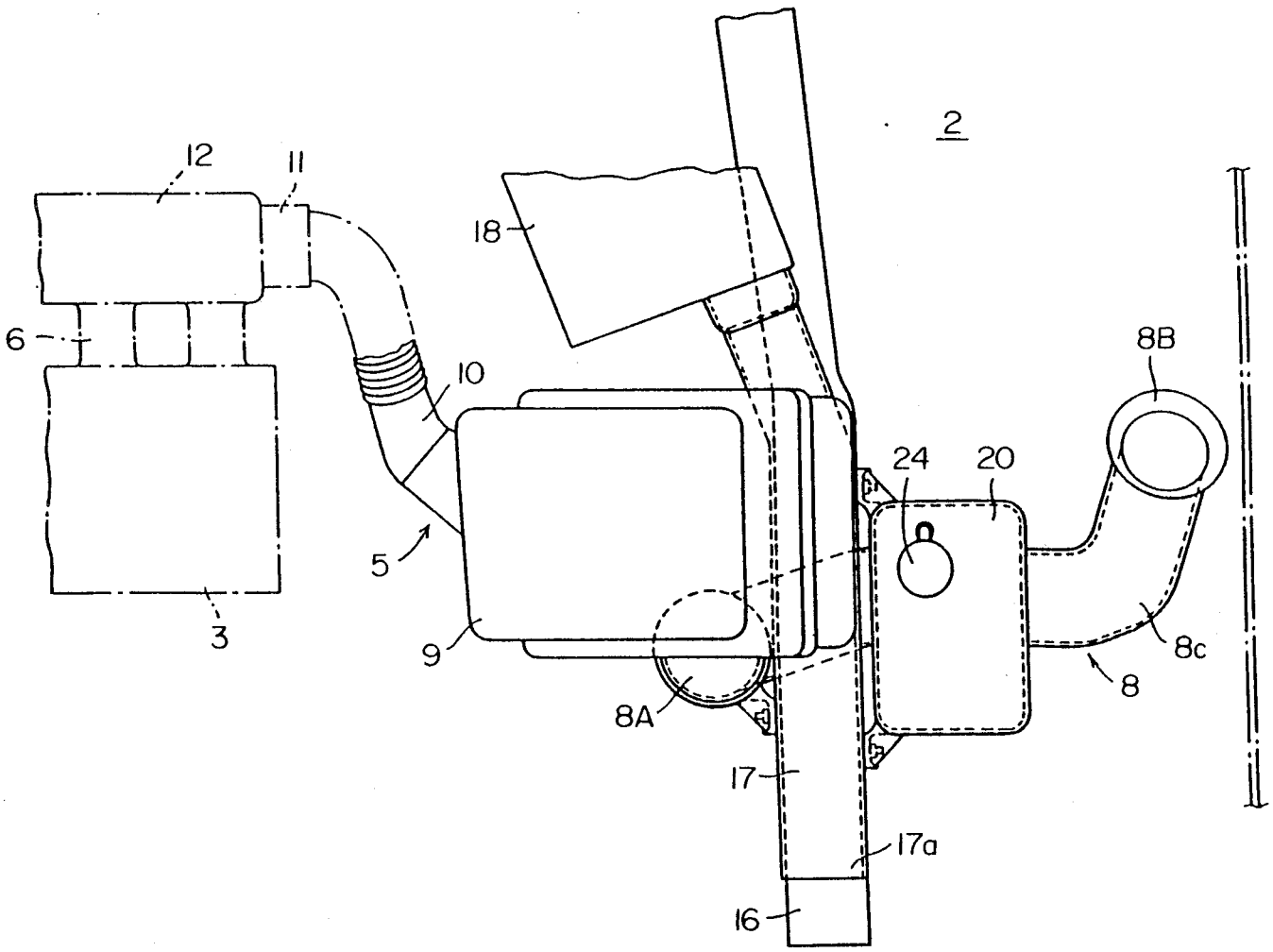
FIG. 3 is a top view of the intake system of FIG. 1.

Referring to the drawings in detail and, in particular, to FIGS. 1 and 3, an intake system in accordance with a preferred embodiment of the present invention is shown. The intake system includes an intake manifold 6, serving as a downstream end of an air intake passage unit 5, which is secured to one side wall of an automobile engine 3 installed in an engine room 2 of a vehicle. The air intake passage system 5 is provided, in order from the upstream end thereof, with an air inlet passage or suction duct 8, an air cleaner 9, a main intake passage or duct 10, a throttle body 11 and a surge tank 12 connected to the intake manifold 6, all of which may be of any known type.

Figure 2:
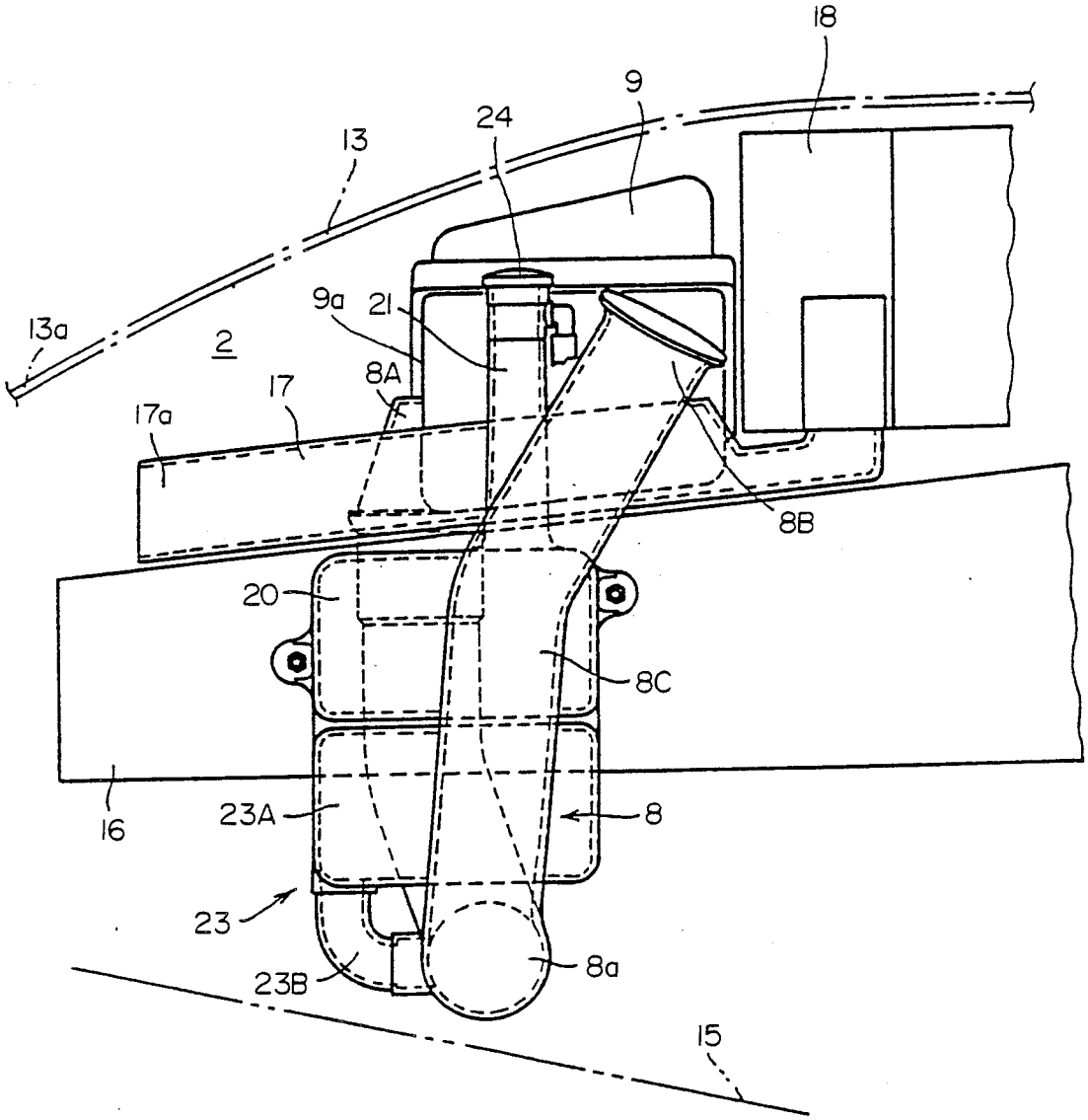
FIG. 2 is a side view of the intake system of FIG. 1.

As is shown in FIGS. 2 and 3, the air cleaner 9 is disposed in a front upper portion of the engine room 2. This front upper portion is close to a front end portion 13*a* of a hood or bonnet 13. The air suction duct 8 has a downstream end portion or air outlet portion 8A connected to a lower portion of a side wall 9*a* of the air cleaner 9 and an upstream end portion or air inlet portion 8B with an inlet opening rearward into an upper portion of the engine room 2. The air suction duct 8 forms a substantially U-shaped passage portion 8C between the air outlet portion 8A and air inlet portion 8B so as to extend below the air cleaner 9. A curved bottom 8*a* of the U-shaped passage portion 8C of the air suction duct 8 is located close to a floor panel 15 of the vehicle.

In a space 19 defined by the U-shaped passage portion 8C there is a hollow, front body frame 16, having a rectangular cross-section, extending in a lengthwise direction of the vehicle so as to form a space between itself and a tapered bottom wall 9*b*. This front body frame 16 is disposed on each side of the vehicle to provide a rigid structure of the front body of the vehicle. The front body frame 16 holds the air suction duct 8 with a retainer clip 16*a*, which grips an end portion of the air outlet portion 8A and is bolted to one side of the front body frame 16. An air duct 17 is disposed above the front body frame 16 and extends in the lengthwise direction, passing through the space 19. The air duct 17 has a substantially triangular cross-section so as to be snugly received in the space 19 between the tapered bottom wall 9*b* of the air cleaner 9 and the front body frame 16. An air inlet 17*a*, located near the front end portion 13*a* of the bonnet 13, is connected to a battery case 18 (see FIG. 3) so as to supply air into the battery case 18 and cool a battery (not shown) in the battery case.

In the space 19 defined by the U-shaped passage portion 8C, a generally box-shaped cooling water reserve or reservoir tank 20 is also disposed. The reservoir tank 20 has a refilling pipe 21 with a cap 24 extending upward to a location near the bonnet 13 and is connected to a radiator (not shown). The reservoir tank 20 is held by the front body frame 16 with retainer clips 16*a* which are bolted to a side of the front body frame 16 opposite to the side at which the air outlet portion 8A of the air suction duct 8 is clipped.

Figure 9:
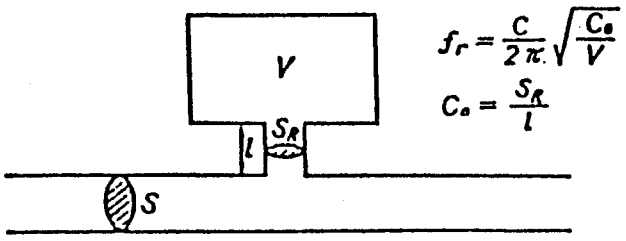
FIG. 9 is an explanatory illustration showing a resonator.

Cooling water reserve tank 20 is equipped with a resonance type of silencing means 23, having a generally box-shaped silencing chamber 23A forming a silencing volume space therein attached to a bottom wall of the cooling water reserve tank 20, and an L-shaped communication pipe 23B, which communicates the silencing volume or space of the silencing chamber 23A with the passage formed inside the U-shaped passage portion 8C of the air suction duct 8 at the curved bottom 8*a*. The silencing chamber 23A is preferably formed integrally with the cooling water reserve tank 20. Dimensions of the silencing means, including the volume of the silencing chamber 23A and the length and inner diameter of the communication pipe 23B, are determined so as to suitably lower the level of noise, having frequencies in a predetermined frequency band, caused in the air intake passage unit 5. When designing the resonance type silence means, a resonance frequency is determined in the following manner. Shown in FIG. 9 is a schematic illustration of a model resonance type silencer. The resonance frequency fr is determined as follows:

$$fr = C/2\tau \times \sqrt{Co/V}$$

$$Co = Sr/l$$

where

C is the velocity of sound and the remaining variables represent properties which are apparent from FIG. 9. It should be noted that the curved bottom 8*a* of the U-shaped passage portion 8C is the location that is apt to rock most easily in the lengthwise direction as the vehicle body vibrates.

The silencing means is a resonance type silencer which is well known in the automobile art.

In the air intake system 5 of the engine intake system, the air suction duct 8 is retained, at the curved bottom 8*a* of the U-shaped passage portion 8C, by the front body frame 16 through the cooling water reserve tank 20 and silencing chamber 23A, which are integrally formed in one piece. This provides a mechanical supporting structure sufficient to control rocking of the air suction duct 8 in the lengthwise direction. Since the silencing chamber 23A, which is in communication with the passage formed in the air suction duct 8, is placed in the space 19, below the cooling water reserve tank 20, which is relatively large, it can be installed in the engine room 2 without requiring an increase in space of the engine room 2 or rearranging elements surrounding the air suction duct 8.

Figure 4:
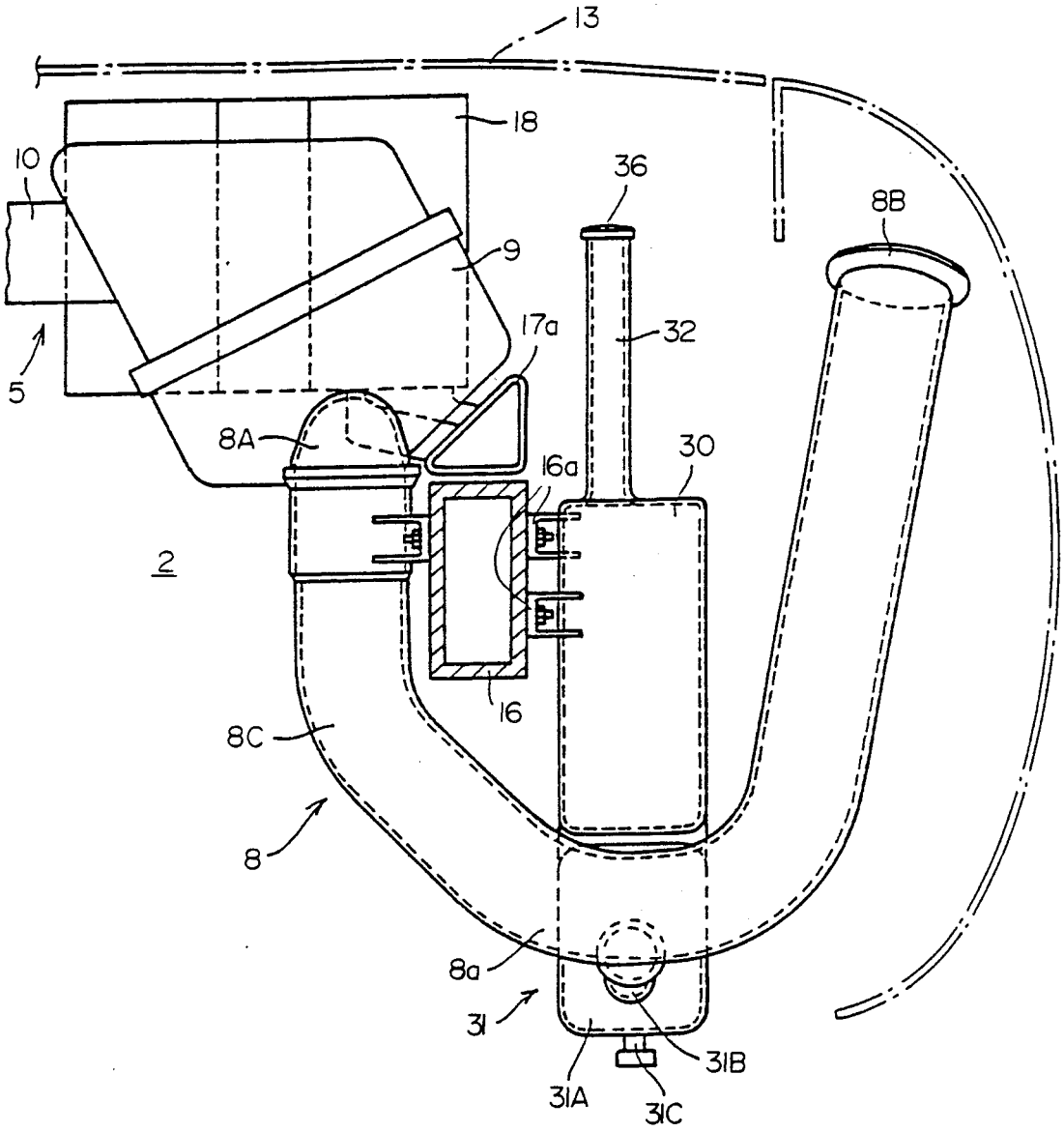
FIG. 4 is a front view of an intake system in accordance with another preferred embodiment of the present invention.
Figure 5:
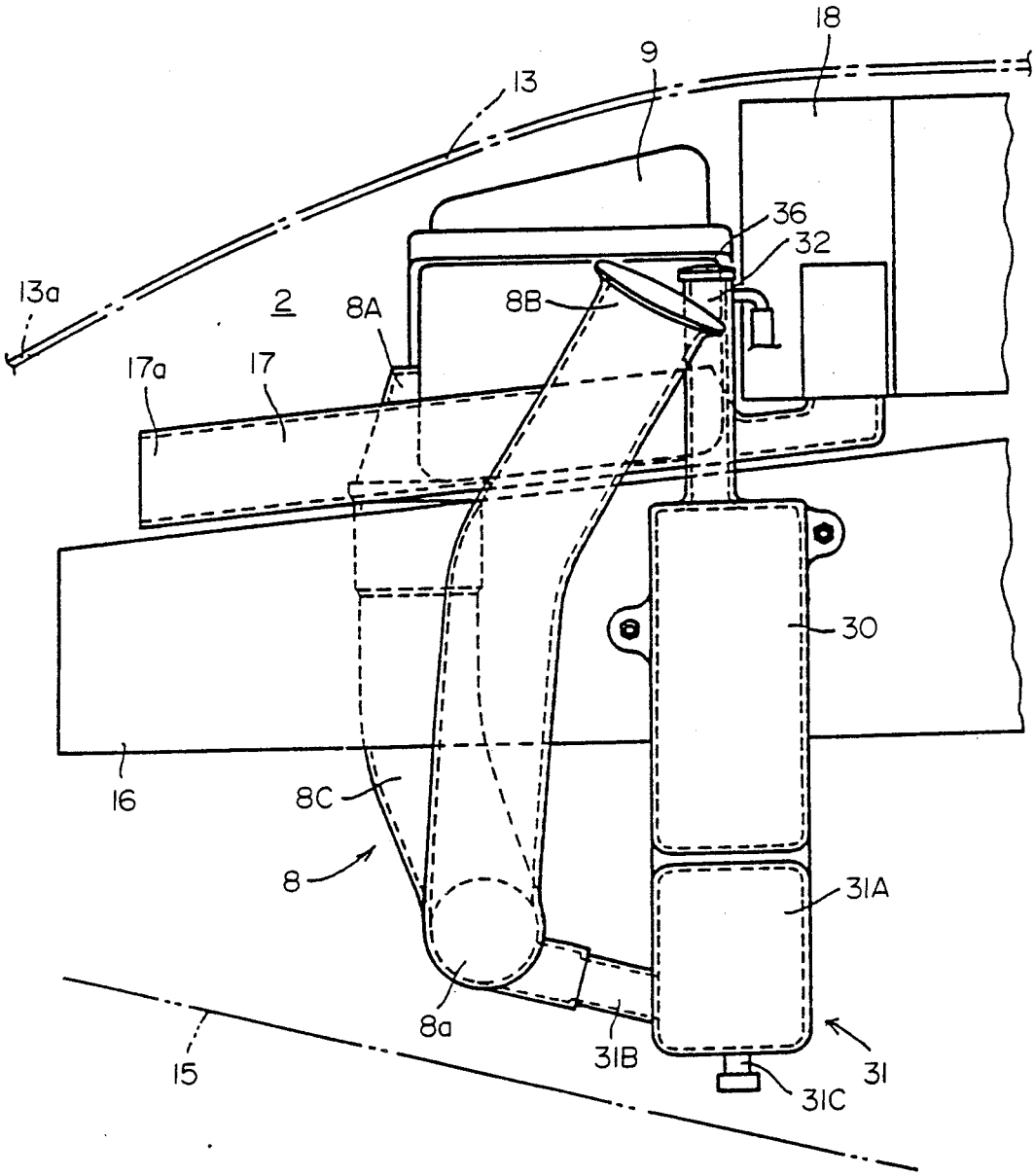
FIG. 5 is a side view of the intake system of FIG. 4.

Referring to FIGS. 4 and 5, a variant of the intake system of FIGS. 1 to 3 is shown which is different from the system illustrated in FIGS. 1 to 3 only in the arrangement of the silencing means. A cooling water reserve tank 30, having a refill pipe 32, with a cap 36, extending upward to a location near the bonnet 13, is placed in the vertical direction within the space 19 defined by the U-shaped passage portion 8C of the air intake system unit 5, and is offset rearward behind the U-shaped passage portion 8C in the lengthwise direction, as is apparent from FIG. 5. The reservoir tank 30 is held by the front body frame 16 with retainer clips 16*a*, which are bolted to one side wall of the front body frame 16.

Silencing means 31 includes a generally box-shaped silencing chamber 31A forming a volume therein. The silencing chamber 31A is attached to a bottom wall of the cooling water reserve tank 30, and a communication pipe 31B extends forward and up from the lower portion of the silencing tank 31A and communicates the volume or internal space of the silencing chamber 31A with the curved bottom 8*a* of the passage formed inside the U-shaped passage portion 8C of the air suction duct 8. The silencing chamber 31A is provided with a drain pipe 31C at the bottom. The communication pipe 31B is inclined so as to be substantially parallel to the floor 15 of the vehicle. The silencing chamber 31A is preferably formed integrally with the cooling water reserve tank 30. Dimensions of the silencing means, including the volume of the silencing chamber 31A and the length and inner diameter of the communication pipe 31B, are determined suitably so as to decrease, as much as possible, the level of noises, caused in the air intake passage system 5, having frequencies in a predetermined frequency band.

In the above variation of the air intake system 5 of the engine intake system, the air suction duct 8 is retained at the curved bottom 8*a* of the U-shaped passage portion 8C by the front body frame 16 through the cooling water reserve tank 30 and silencing means 31, which are formed integrally together. This provides a mechanical supporting structure sufficient to control rocking of the air suction duct 8 in the lengthwise direction. Since the silencing means 31, which is in communication with the passage formed in the air suction passage 8, is placed in the space left behind air suction duct 8, which is fairly large, the silencing means can be installed in the engine room 2 without requiring an increase in volume of the engine room 2 or rearranging elements surrounding the air suction duct 8. Furthermore, because the communication pipe 31B is inclined downward from the curved bottom 8*a* of the U-shaped passage portion 8C to the bottom of the silencing tank 31A, where the drain pipe 31C is provided, water contained in air passing through the air suction duct is collected in the communication pipe 31B and the silencing chamber 31A as it flows through the U-shaped passage portion 8C and is easily discharged through the drain pipe 31C.

Figure 6:
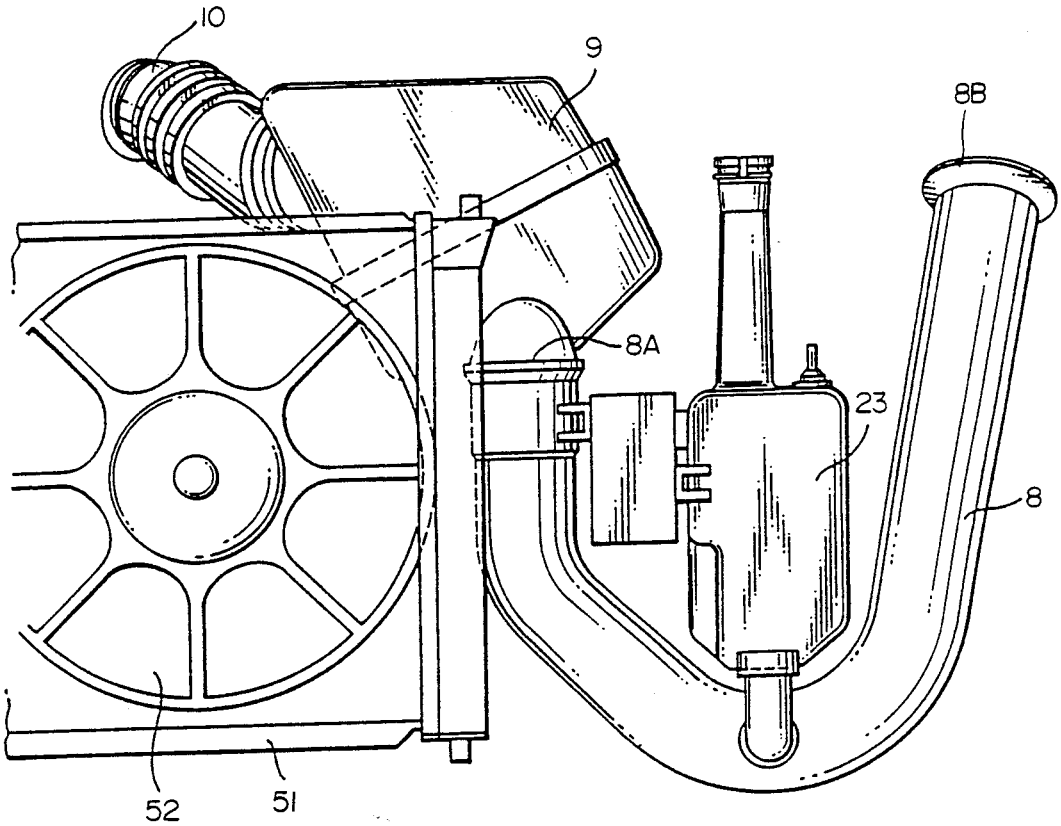
FIG. 6 is a front view of an intake system in accordance with still another preferred embodiment of the present invention.
Figure 7:
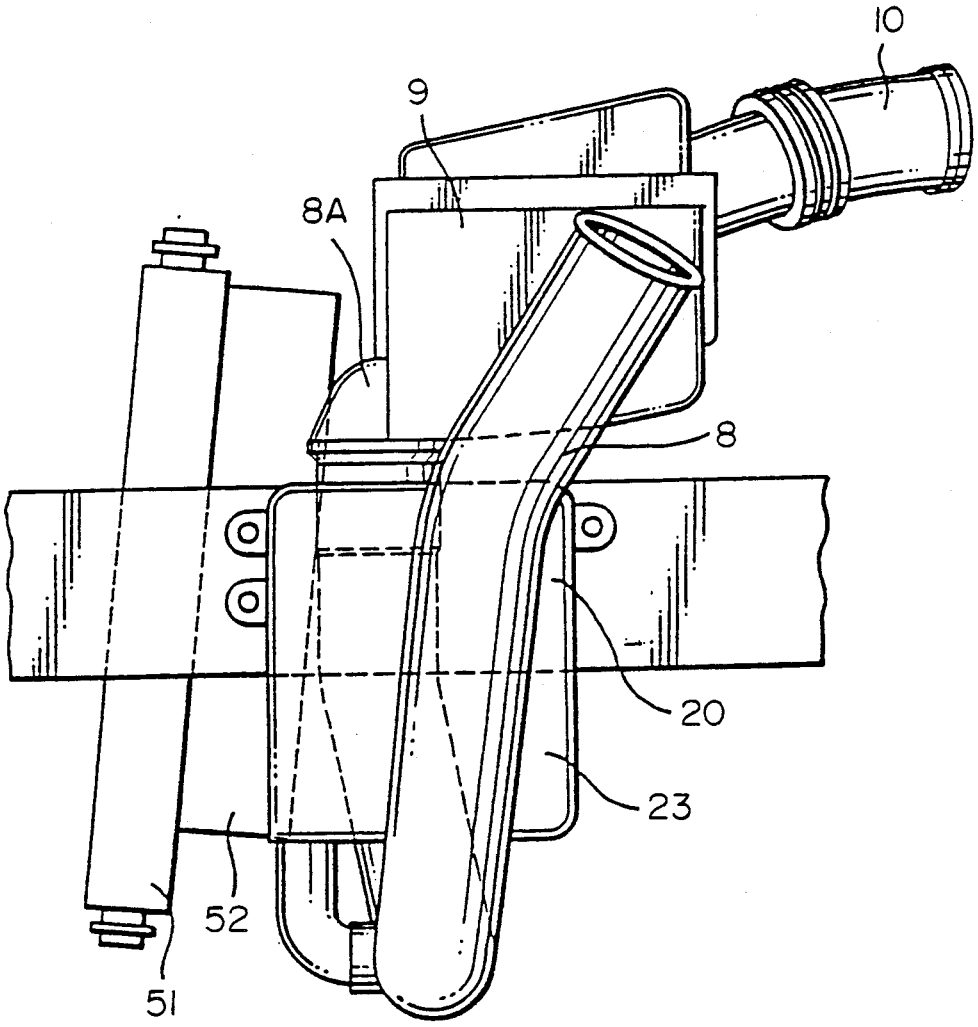
FIG. 7 is a side view of the intake system of FIG. 6.
Figure 8:
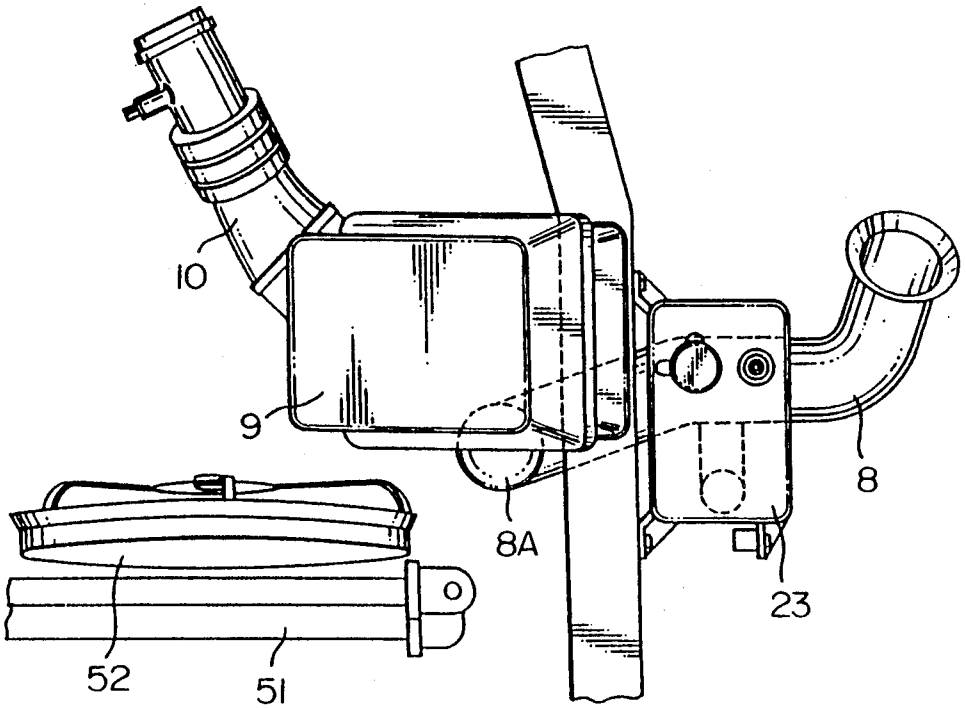
FIG. 8 is a top view of the intake system of FIG. 6.

Referring to FIGS. 6 to 8, an arrangement of the intake system 5 with respect to a radiator 51 and a radiator fan 52 is shown. The radiator 51 and radiator fan 52, which are combined into one unit, are disposed at a front side of both the engine 3 and the intake system, lengthwise of the car body, in the engine room 2. In order to avoid interference of the suction duct 8 and the cooling water reserve tank 20 disposed laterally away from the radiator 51, the suction duct is extended under the silencing means 23 at the bottom of the cooling water reserve tank and extends upward between the radiator 51 and the silencing means 23 near the top of the radiator fan 52.

Air cleaner 9, offset rearward in the lengthwise direction with respect to the vehicle, relative to the air outlet portion 8A of the air suction duct 8, is disposed behind the radiator 51 and is placed partly above the radiator 51. Between the front end of the air outlet portion 8A of the air suction duct 8 and the front wall of the air cleaner 9, a deflector 7 is provided so as to communicate the air outlet portion 8A with the air cleaner 9.

Main intake duct 10 extends rearwardly and up from the air cleaner 9 on the inner side of the air cleaner 9 and is located above the radiator fan 52.

It is to be understood that although the present invention has been described in detail with respect to preferred embodiments thereof, various other embodiments and variants may occur to those skilled in the art which fall within the scope and spirit of the invention. It is intended that such other embodiments and variants be covered by the following claims.

What is claimed is:

1. An intake system installed in an engine room of an automobile for supplying air into an internal combustion engine through an intake passage, said intake system comprising:

an air cleaner connected to one end of said intake passage remote from said internal combustion engine;

an air inlet passage for introducing air into said air cleaner, said air inlet passage comprising an outside passage portion, formed with an inlet opening at an upper portion thereof and extending downward from said inlet opening, an inside passage portion extending upward to said air cleaner, and a generally U-shaped intermediate passage portion extending between said outside and inside passage portions to form a space between said outside and inside passage portions;

a stationary liquid container disposed close to said space;

silencing means, formed integrally with said liquid container and having an interior space therein, for decreasing noises caused by air introduced into said intake system; and a connecting passage for connecting and communicating said interior space with said air inlet passage at said generally U-shaped intermediate passage portion.

2. An intake system as recited in claim 1, wherein said connecting passage extends between a bottom portion of said generally U-shaped intermediate passage portion and said silencing means.

3. An intake system as recited in claim 2, wherein said silencing means is placed in said space between said outside and inside passage portions.

4. An intake system as recited in claim 3, wherein said connecting passage extends downward from a bottom of said silencing means to a bottom portion of said generally U-shaped intermediate passage portion.

5. An intake system as recited in claim 2, wherein said silencing means is placed behind said space between said outside and inside passage portions and downward of said bottom portion of said generally U-shaped intermediate passage portion.

6. An intake system as recited in claim 5, wherein said connecting passage extends rearwardly of and down from the bottom portion of said generally U-shaped intermediate passage portion to a side of said silencing means.

7. An intake system as recited in claim 6, further comprising a water drain disposed at a bottom of said silencing means.

8. An intake system as recited in claim 6, further comprising retainer means for rigidly connecting said liquid container to a front frame extending in a lengthwise direction of a car body of said automobile.

9. An intake system as recited in claim 1, wherein said liquid container is a reservoir tank for a radiator.

10. An intake system as recited in claim 1, wherein said liquid container is a washer tank for a front windshield washer system.

11. An intake system having an intake passage extending rearward from near an upper outer side of a radiator fan, installed in an engine room of an automobile, for supplying air into an internal combustion engine through said intake passage, said intake system comprising:

a generally U-shaped air inlet passage disposed between said radiator fan and a side wall of said engine room for introducing air into said intake system;

an air cleaner connected between said intake passage and said generally U-shaped air inlet passage and placed behind a downstream end of said generally U-shaped air inlet passage and above and on an outer side of said radiator fan; and a deflector passage forming a downstream end part of said generally U-shaped air inlet passage for connecting said generally U-shaped air inlet passage and said air cleaner, said deflector passage extending rearward from said downstream end to said air cleaner.

12. An intake system as recited in claim 11, wherein said generally U-shaped air inlet passage comprises an outside passage portion formed with an inlet opening at an upper portion thereof, said outside passage portion extending downward from said inlet opening, an inside passage portion extending upward to said air cleaner, and a U-shaped intermediate passage portion extending between said outside and inside passage portions so as to form a space between said outside and inside passage portions.

13. An intake system as recited in claim 12, further comprising a stationary liquid container disposed close to said space, silencing means formed integrally with said liquid container and having an interior space therein for decreasing noises caused by intake air introduced into said intake system, and a connecting passage for connecting and communicating said interior space with said generally U-shaped air inlet passage at said U-shaped intermediate passage portion.

14. An intake system as recited in claim 13, wherein said connecting passage extends between a bottom portion of said U-shaped intermediate passage portion and said silencing means.

15. An intake system as recited in claim 14, wherein said silencing means is placed in said space between said outside and inside passage portions.

* * * * *